US005145253A

United States Patent [19]

Paul et al.

[11] Patent Number: 5,145,253

[45] Date of Patent: Sep. 8, 1992

[54] BLENDER FOR PARTICULATE MATERIAL

[75] Inventors: Kermit D. Paul; Leslie C. Bartholomew; John S. Szazdi, Jr., all of Bethlehem; Gerald J. Labelle, Allentown, all of Pa.

[73] Assignee: Fuller Company, Bethlehem, Pa.

[21] Appl. No.: 526,198

[22] Filed: May 21, 1990

[51] Int. Cl.[5] ..... B01F 13/02; B01F 15/02

[52] U.S. Cl. ..... 366/101; 366/136; 366/141; 366/151; 366/159; 366/341; 406/30; 406/163; 406/181

[58] Field of Search ..... 366/101, 106, 107, 136, 366/137, 141, 151, 159, 191, 193, 341; 406/30, 32, 128, 142-143, 146, 163, 181; 177/64, 105

[56] References Cited

U.S. PATENT DOCUMENTS

| | | | |
|---|---|---|---|
| 2,872,249 | 2/1959 | Mertes | 406/30 |
| 2,905,538 | 9/1959 | McIntire | 406/30 X |
| 3,145,975 | 8/1964 | Towns, Jr. | 366/159 X |
| 3,179,378 | 4/1965 | Zenz et al. | 366/106 |
| 3,361,413 | 1/1968 | Heyl | 366/159 X |
| 4,068,828 | 1/1978 | Goins | 366/136 |
| 4,498,783 | 2/1985 | Rudolph | 366/141 X |
| 4,834,544 | 5/1989 | Paul | 366/101 |
| 4,907,892 | 3/1990 | Paul | 366/101 |
| 4,978,227 | 12/1990 | Paul | 366/101 |
| 5,074,670 | 12/1991 | Paul | 366/101 |

FOREIGN PATENT DOCUMENTS

| | | | |
|---|---|---|---|
| 1143791 | 12/1959 | Fed. Rep. of Germany | 366/137 |
| 8203844 | 11/1982 | PCT Int'l Appl. | 406/30 |

*Primary Examiner*—Philip R. Coe
*Assistant Examiner*—C. Cooley
*Attorney, Agent, or Firm*—Daniel De Joseph

[57] ABSTRACT

An integrated process blending apparatus which blends particulate material and also automatically controls the flow of material into the blender and out to the associated processing equipment. Load cells attached to the blender vessel are used to control the entry of material into the blender, while the pressure drop in the blender output pipe is used to control an output deflector to either remove or recycle material within the blender. The blender is also made more effective by dividing it into vertical compartments with separators which have angled portions preferably in their lower regions to cause different downward flow velocities in each compartment, and by creating a multistage blender by stacking sets of offset compartments one on top of another.

4 Claims, 4 Drawing Sheets

BLENDER FOR PARTICULATE MATERIAL

BACKGROUND OF THE INVENTION

This invention deals generally with a blender for solid particulate matter, and more specifically with a blender of the type which is a cylindrical vessel with a central lift column or pipe through which a gas is pumped to move material from the bottom to the top of the vessel for mixing.

Mineral feed to crushing equipment varies in chemical composition and in other critical properties such that there is a need for homogenizing the feed to the downstream process. This is strictly done by utilizing the blender means such as a particulate blender intermediate the crushing equipment and the downstream process.

Particulate blenders which are cylindrical vessels with central lift pipe of column to raise inventory from the bottom of the blender to the top for mixing are well known in the art. They are available in versions which feed the new material into the vessel at either the bottom or the top of the vessel, and both types use a gas pumped up through the central pipe to lift material from the bottom to the top, which material is then moved by gravity to the bottom again through various deflector structures which cause the material to be mixed.

Such blenders are used to primarily blend free flowing granular materials both in the batch and continuous mode. When non-free flowing materials, such as certain powders, are used, however, the customarily narrow internal blending passageways, tubes or channels can tend to become blocked and rendered ineffective. It would be desirable, therefore, to have a design which can function on non-free flowing materials in a blending mode, with a high degree of energy efficiency.

These objectives are realized by providing a blender in which the internal volume is compartmentalized with large flow passage areas for the non-free flowing materials which are also designed to create differences in velocity and mixing as material passes through the blender. The blender of this invention is also adaptable to internally recycle blender inventory such that the net flow to the subsequent downstream process can be set in control at a predetermined rate to thereby integrate process feed with the blending function and, in addition, to provide a means controlling the process feed rate.

SUMMARY OF THE INVENTION

The present invention employs a deflector means to control the quality of material being removed from the blender. This deflector is located within a continuation of the lift pipe of the blender. This deflector is deployed so as to permit a portion of the material moving up the lift pipe to be diverted into a material/air disengaging chamber. The deflector itself can be preset to be automatically controlled by a sensor means which can measure the actual total flow of material from the blender to a downstream process. The sensor means can utilize any sensing method which can be suitably calculated to give the desired information. For instance, the sensor means can be a pressure sensing means whereby it will measure the pressure differential across a fixed length in the exit pipe located downstream of the deflector through which the material leaving the blender passes and thereby calculate the particle flow rate as a function of such measurement.

One element of this invention contemplates integrating the central lift pipe blender into a continuous process by constantly monitoring the weight of the material in the blender, and adding new material when the total material weight decreases below a predetermined value, or continuously adding new material and adjusting the addition rate such as by servo controls. The inventory in the blender is thereby controlled to a fixed value corresponding to its filled condition. It is understood that this rate of material addition is thus equal to the rate of material fed to the downstream process. This constant replenishing of the material in the blender is essential to having a continuous process, because it becomes an automatic response to the removal of material which is being forwarded to subsequent processing operations.

The invention also includes features within the blender itself which improve the blending action over the degree of blending which has previously been available. To attain this improved blending capability, a plurality of vertical partitions are located within the gravity blending chamber to divide the vessel into two or more vertically oriented compartments which are sufficiently large to facilitate the passage of non-free flowing material therethrough. These partitions are oriented in an essentially vertical plane to permit the downward flow through the partitions of particulate material by gravity. Moreover, at least one, but not necessarily all of the partitions are further divided into at least two portions. These portions are all located in an essentially vertical plane but have different slopes to thereby create, in the two adjacent compartments having said divided partition in common, differences in cross-sectional flow areas. These portions of the partition can be oriented at angles to each other. Alternatively, rather than be divided into "portions", at least one partition can be in the form of a spiral having an infinite number of different slopes. In the preferred embodiment of the invention, at least one partition in the blender is divided into portions, both of which are in a generally vertical orientation but constructed so that the lower portion is angled more off the vertical than the upper portion. This will result in different downward flow rates for material on different sides of the same partition, assuming every partition in the blender is not constructed in exactly the same fashion, and therefore increases the blending action, in that the mixing action of a lift pipe type blender is to some extent dependent on the existence within the vessel of multiple downward flow rates for the material. When diverse downward flow rates exist, it means that various parts of the material starting from the top of the blender at any one time will reach the bottom at different times. At the bottom, each part of the initial top layer will therefore be picked up by the lift pipe along with and mixed with material from other levels within the vessel with which it was not previously associated. Thus, the different downward flow rates contribute significantly to the mixing action.

When the vertically oriented partitions are arranged radially around the center lift pipe, each compartment within the blender will therefore be bounded by (1) two vertical partitions, (2) the outer surface of the lift pipe and (3) the inner surface of the shell of the blender. For example, in the preferred embodiment of the invention described above, the differences in velocity within each compartment within the blender can be pre-established by the ratio of the cross sectional areas immediately above and below the junction between the two portions of the vertical partition. By way of example, if there are two adjacent compartments in the blender of the present invention that have equal cross sectional areas at the top of each compartment above the junction but different cross sectional areas beneath the junction at the bottom of the compartments, beneath the sloped partition plates, the compartment that has a greater cross sectional area at the bottom of the compartments will have a higher velocity through the entire length of the blender than the compartment that has the smaller cross-sectional area. Generally, if the compartments within the blender are kept constantly full of material, the ratio of the velocities between such compartments will be equal to the ratio of the cross sectional areas beneath the junction between the two portions.

Another means for improving the blending action is to stack two or more sets of partitions vertically one above another. In this multiple stage blender, each group of partitions is offset from the one above it. This essentially subjects the material to additional mixing action because, as material leaves the bottom of one set of partitions, it is split by the next lower set of partitions and mixed with other material which was previously flowing in another vertical compartment. The result is improved blending. Preferably at least one partition in each set of partitions will be constructed in a spiral fashion or divided into two portions as described above.

The invention therefore furnishes a blender which not only can be integrated into a continuous process providing feed control to a process as well as blending, but also provides a blender whose design furnishes more effective blending than had previously been available.

DETAILED DESCRIPTION OF THE INVENTION

Figure 1:
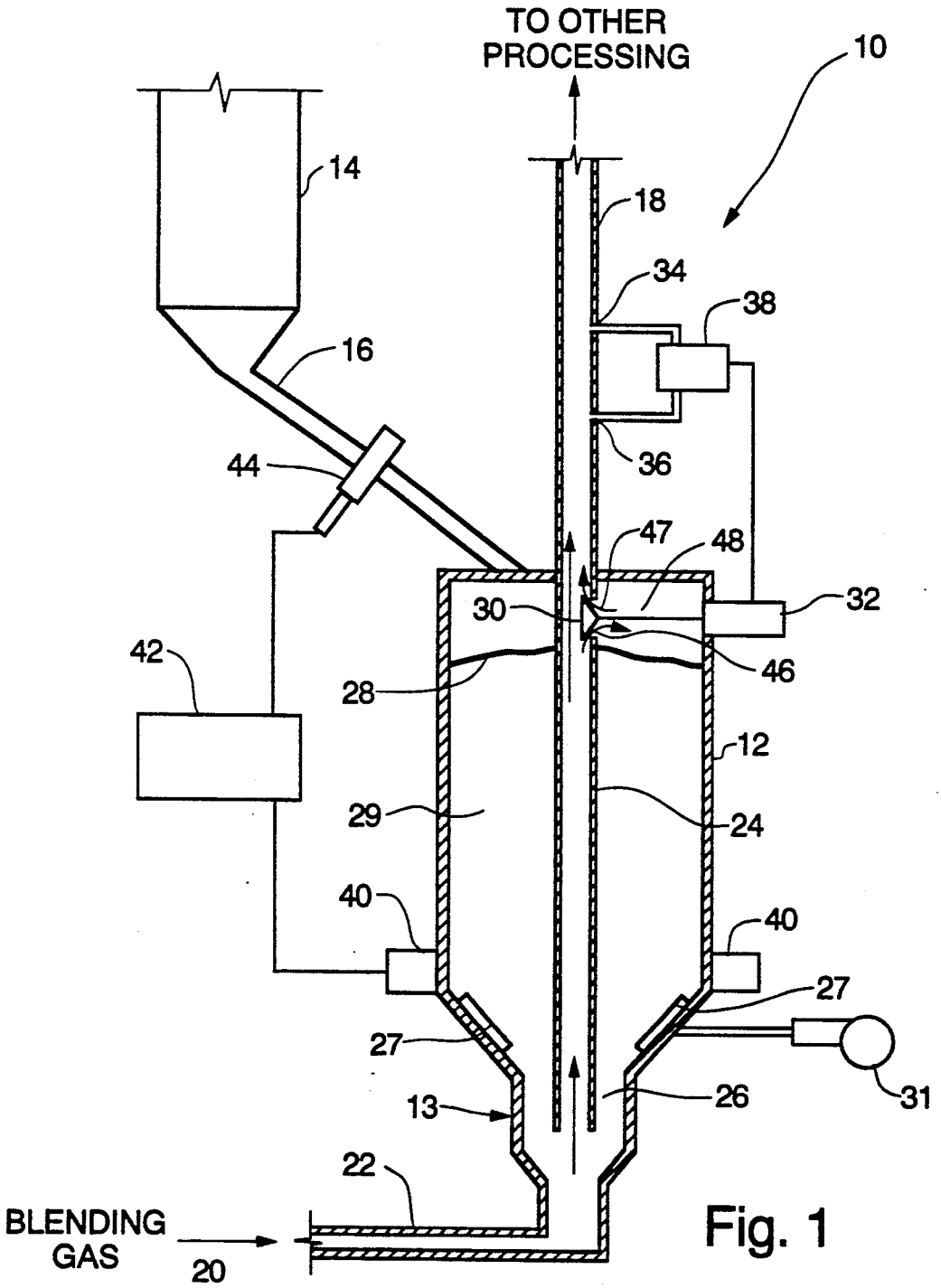
FIG. 1 is a simplified schematic drawing of a processing system in which the present invention is installed.

FIG. 1 is a simplified schematic diagram of a processing system 10 in which the invention is installed. Blender 12 is shown in cross section to better describe its function, while other parts of the system are shown in schematic form.

Container 14 contains raw material before blending, that is, material which is not thoroughly intermixed, which is transported through pipe 16 and fed to blender 12 for mixing. After blending, the material is transported from blender 12 to subsequent processing apparatus (not shown) through exit pipe 18.

Blender 12 operates in somewhat conventional fashion in that blending gas 20 is fed into the bottom of blender 12 through pipe 22, and the gas moves up lift pipe 24, taking with it material which has moved down in blender 12 to reach seal leg 26, which seal leg is defined by the tubular extension 13 to blender 12 and the lift pipe 24 for which the inlet thereof is placed near the bottom of tubular extension 13. The downward motion of the material in the preferred embodiment shown in FIG. 1 is aided by air slides 27 which are fed air from blower 31. Air slides 27 aerate the material which contacts them, and facilitate its travel downward.

In one embodiment of the present invention lift pipe 24 continues up to meet and join exit pipe 18. Moreover, deflector 30 is located within lift pipe 24 near the top of the blender 12, approximately where a conventional lift pipe would terminate. The function of deflector 30 is to divert a selected amount of the gas and material moving up lift pipe 24 into the top of blender 12 through first opening 46 into air disengaging chamber 48, while permitting this diverted gas, void of most of its material, to return, via second opening 47, to join the rest of the non-diverted gas and the material carried with it to proceed into and through exit pipe 18 to the subsequent process. Substantially all the gas which enters the bottom of lift pipe 24 will flow through exit pipe 18. First opening 46 and second opening 47 are shown to greater detail in FIG. 2.

The material diverted, via first opening 46, into the top of blender 12 falls onto top surface 28 of material 29 within blender 12 and therefore continues to be remixed with fresh feed from 14 and eventually it is again transported by lift pipe 24 toward the top of blender 12, where it once more can move either into exit pipe 18 or back into blender 12. The gas that exited lift pipe 24 with the material being recycled reenters exit pipe 18 via second opening 47 again above deflector 30 and continues to aid the movement of the material in exit pipe 18.

The position of deflector 30 is controllable by positioner 32, so that the amount of material recycled or forwarded to the next process can be varied by an operator, process controller or computer. For instance, deflector 30 can be positioned so that virtually all of the gas and material moving up central left pipe 24 will go to the subsequent process. Alternatively, it can be positioned so that most of the material will be deflected and recycled back to inventory. For continuous feedback control of the feed of material to the subsequent process it is also possible to measure the relative quantity of material leaving blender 12 through exit pipe 18. For one method of measuring the quantity of said material, it has been discovered that the pressure gradient in a vertically oriented conveying line is substantially proportional to the rate of material transfer within said line. Thus, gas pressure sensors 34 and 36 are attached at a location sufficiently remote from the entry to exit pipe 18 so that they react to the quantity of material flowing within exit pipe 18. Gas pressure sensors 34 and 36 are connected to control means 38 which measure the pressure differential between the sensors spaced in accordance with the pre-established distance along the length of the pipe between sensor 34 and sensor 36, of exit pipe 18 and converts it to an indication of material flow by which to control positioner 32, which in turn controls deflector 30 to vary the quantity of material flowing in exit pipe 18.

Figure 2:
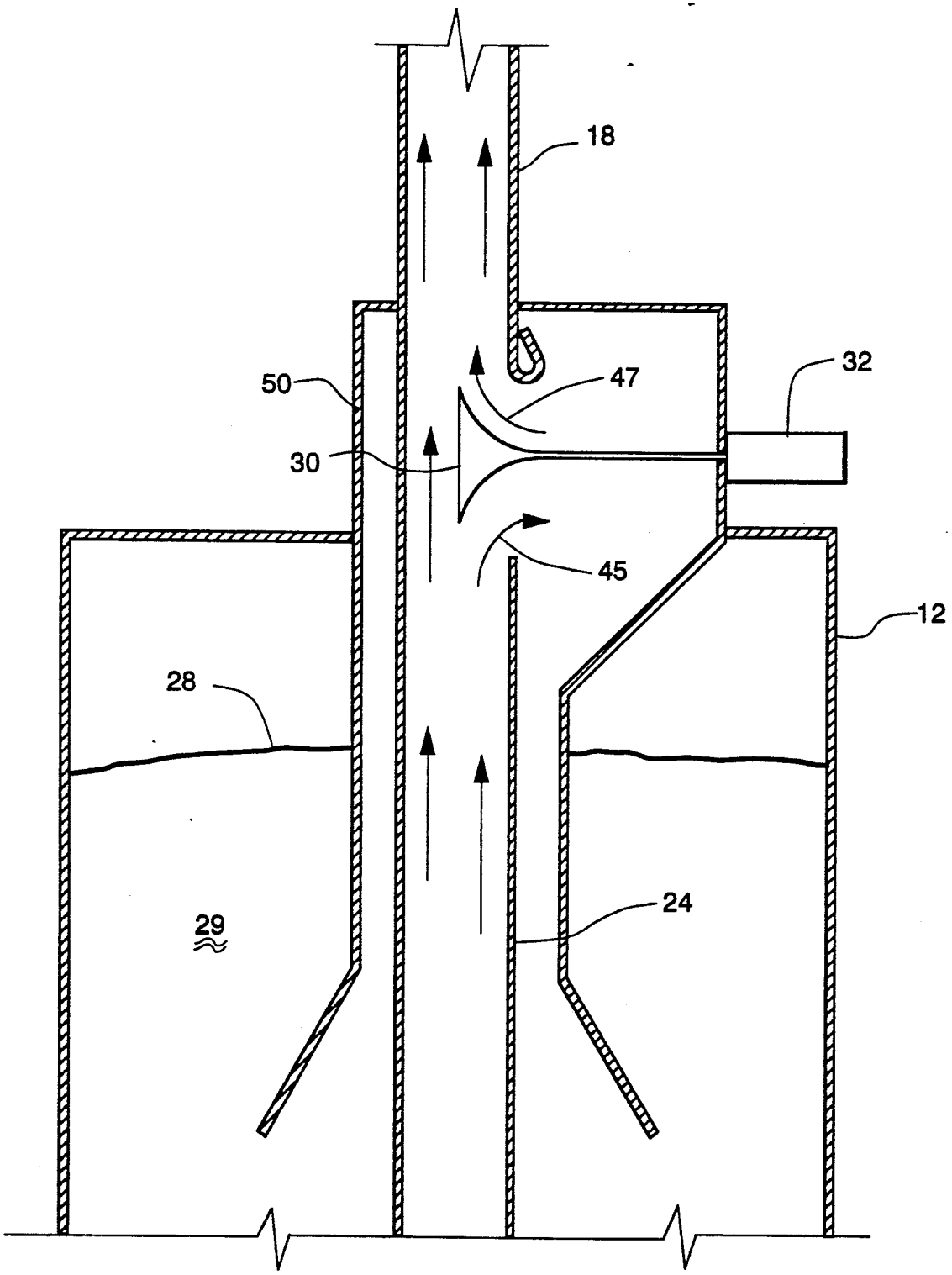
FIG. 2 is a partial cross section of the output flow control of the preferred embodiment of the invention.

It is understood that deflector means 30 can be any of a number of sizes and shapes as long as it is able to fulfill its primary function of extracting a portion of the air and material flow existing in lift pipe 24 upstream of deflector means 30. For example, deflector means 30 can be in the form of a generally U-shaped device as shown in FIG. 1 and FIG. 2 or can be in the form of a rotated or pivoted single or double set of blades.

With the quantity of material leaving blender 12 automatically controlled, all that is required for complete continuous processing is to control the quantity of raw material entering blender 12. This can be accomplished by continuously measuring the quantity of material within the blender, such as, for instance, by continuously monitoring the weight of blender 12, including, of course, the material contained by the blender, utilizing conventional load cells 40 attached to its lower outside surface. Load cells 40 are interconnected with controller 42, which opens and closes valve 44 in pipe 16 to control the amount of raw material entering blender 12 from raw material storage container 14. Since the weight of blender 12 is directly related to the flow of material out of it, the replenishment of material into blender 12 is automatic and the process control is complete.

As an additional feature of this invention, a process calibration check can be made to the system by closing the feed to the blender, which in FIG. 1 would be realized by closing valve 44, and thereafter monitoring the actual loss in weight of the entire blender as measured by load cells 40, as a function of time, and then comparing this actual loss of weight against the desired process feed rate being controlled by the above described process feed control system as regulated by deflector 30, positioner 32, sensors 34 and 36 and control 38. Ideally, the desired feed rate of the blender to the process as measured by the process feed control system would be equal to the actual loss in weight of the entire blender as measured by the load cells 40. Any deviations from the actual loss in weight of the entire blender can be adjusted within the process feed control system as described above.

It should be appreciated that in order for the embodiment shown in FIG. 1 to operate satisfactorily and to have gas continuously flowing out through exit pipe 18, the entire structure of blender 12 must be relatively gas tight. Such a requirement is difficult to fulfill in a large structure, so an alternate embodiment of the invention is pictured in FIG. 2 which includes a seal or hood structure 50 around exit pipe 18. While the structure and action of the embodiment of FIG. 2 is very similar to that of FIG. 1, the limited volume of hood 50 makes the task of sealing the gas flow around exit pipe 18 much easier. As shown in FIG. 2, hood 50 extends downward well below top surface 28 of material 29. Thus, material leaving lift pipe 24 falls to the bottom of hood 50, and along with material 29 outside the bottom of hood 50, forms a gas seal at the bottom of hood 50. All that is then required to attain a perfect gas seal for the system is to form seals around positioner 32 and exit pipe 18, which is well within the ability of those skilled in the art.

Figure 3:
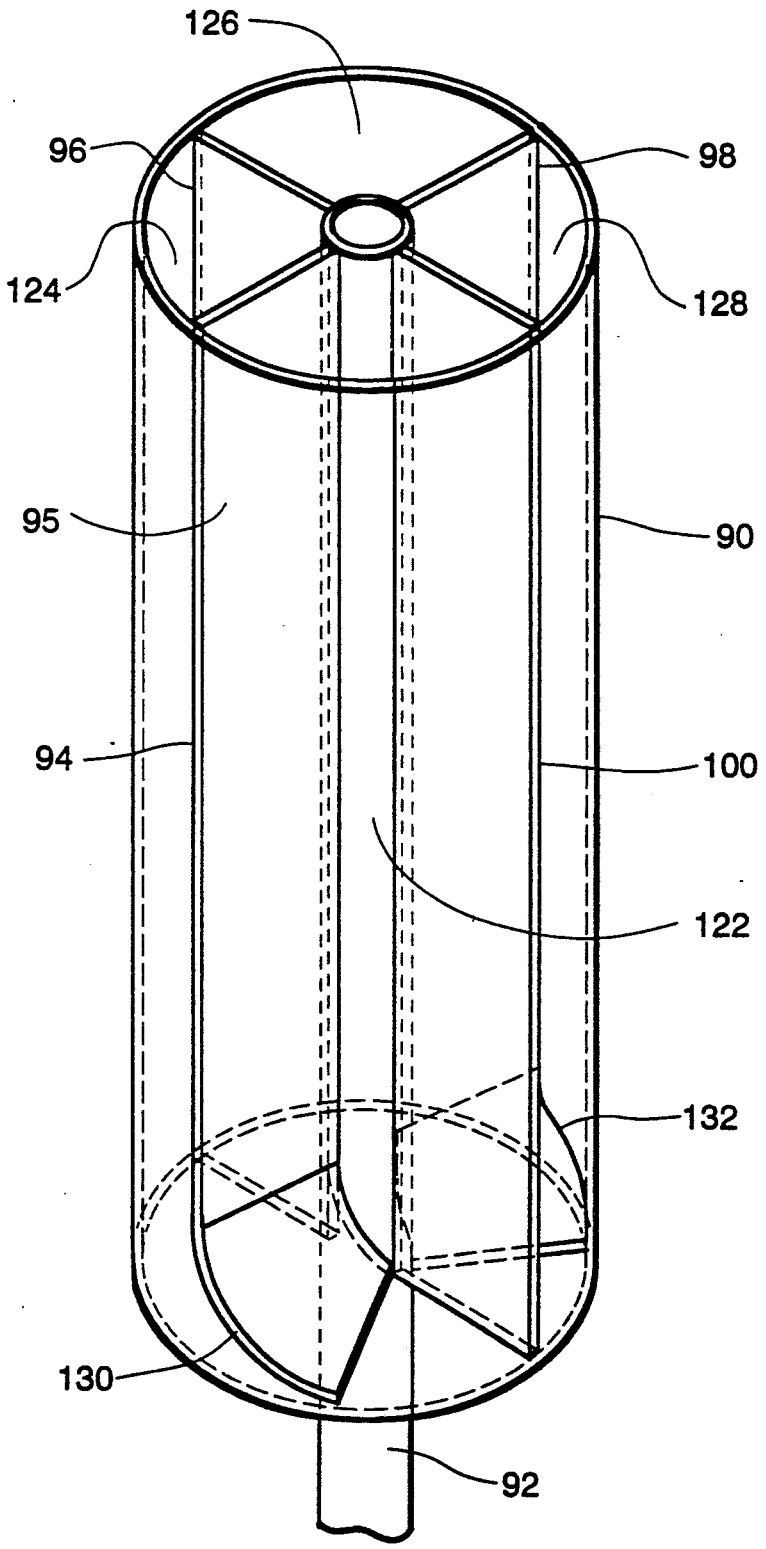
FIG. 3 is a partial cross section of an embodiment of the invention showing a vertical partition with a angled lower portion.

FIG. 3 shows a structural feature which is added to the lift pipe type blender of the present invention to improve its blending characteristics. For better clarity of illustration in FIG. 4, the outer walls of blender vessel 90 have been shown as if they were transparent and the vessel top has been omitted.

The embodiment of the invention shown in FIG. 3 includes conventional lift pipe 92, centrally located within blender vessel 90, with radial vertical partitions 94. 96. 98 and 100 oriented so that they form isolated compartments 122. 124. 126 and 128. It is preferred that the partitions are radial in the sense that they radiate out from the outer surface of lift pipe 92. However, it is understood that the partitions may be shaped in different fashions, as long as they serve to subdivide blender 90 into essentially vertical compartments. It is through these compartments that material lifted to the top of lift pipe 90 and thrown out at the top of the vessel moves downward, along with fresh feed fed to blender 90. It is understood that a blender according to this invention can have a different number of compartments than shown by FIG. 3. It is only necessary that a blender have two or more compartments.

Sloping panel or portion 130 of partition 94 provides blender 90 with more effective blending characteristics. Whereas the upper portion of partition 94 above sloping panel 130 is in an essentially vertical plane, sloping panel 130, which is also in an essentially vertical plane to permit the passage of material through the compartment by gravity, is obviously offset more from the vertical plane than the upper portion 95 of partition 94. Panel 130 slopes into compartment 122, and therefore reduces the downward flow rate of material within that compartment by reducing the cross section of the flow area, relative to the flow area above the panel, in the lower part of the compartment. However, at the same time, the slope of panel 130 also increases the flow rate within compartment 124 by increasing the cross section flow area, relative to the flow area above the panel, in the lower region of that compartment. Sloping panel 132, shown partially with phantom lines, has the same effects on compartments 128 and 126.

As discussed previously, effective blending depends essentially upon producing different downward flow rates within the blender, and by the simple device of sloping panels within a vessel, preferably in the lower region of a vertically divided vessel, the effectiveness of a blender can be considerably improved. Furthermore, although FIG. 3 shows the interior o the blender 90 divided into four compartments through the use of four partitions, it is understood that there can be utilized more or less partitions to create more or less interior compartments, depending on the needs of the individual practitioner of this invention.

Figure 4:
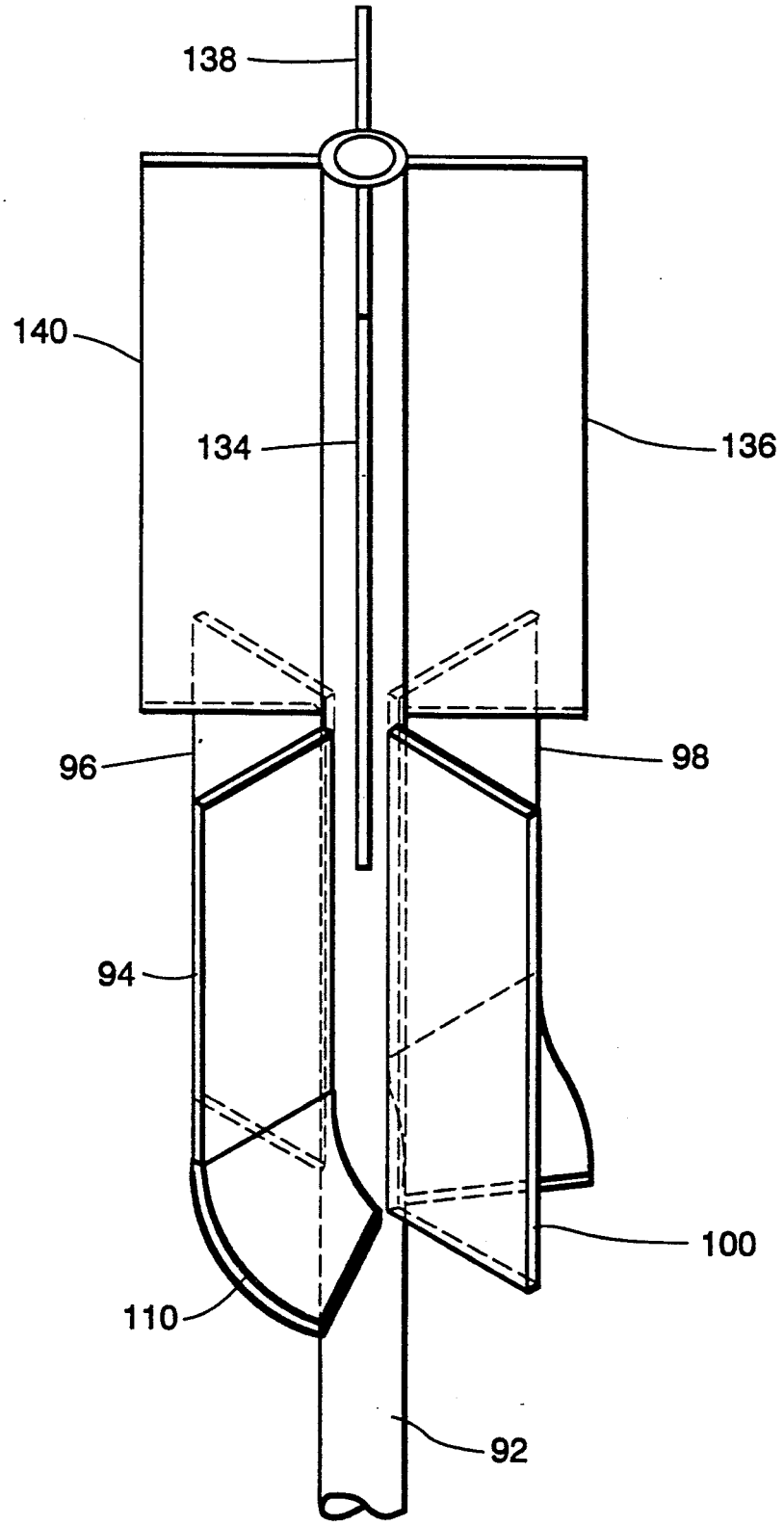
FIG. 4 is a partial cross section of an embodiment of the invention showing a two stage blender with offset partitions.

FIG. 4 shows an alternate embodiment of a blender constructed with compartments. For clarity in FIG. 4, the walls and top of the vessel of the blender are omitted. The embodiment of FIG. 4 essentially involves the addition of another set of partitions 134, 136, 138, and 140 above the set shown in FIG. 3. The partitions stacked above the lower set of partitions are, however, offset from the lower set, and not mere extensions of the lower partitions.

While partitions 134, 136, 138, 140 are shown rotated around central lift pipe 92 relative to partitions 94–100, other configurations could also be used. For instance, parallel partitions might be used for the upper set, while radial partitions similar to those shown in FIG. 4 are used for the lower set. The essential criteria in this embodiment of the invention is that the adjacent sets of partitions be located so that an upper compartment feeds the material leaving at its bottom into more than one lower compartment. In that manner each junction between compartments causes an additional mixing action within the blender, because each lower compartment receives material from more than one upper compartment.

Although FIG. 4 shows a sloped panel 110 located at the bottom of the second set of partitions, i.e., partitions 94, 96 and 100, it is understood that there can be one or more sloping panels located at some point along the length of one or more of partitions 134, 136, 138 and 140 and preferably along the lower ends of each of the partitions leading into the second set of partitions, as further illustrated in FIG. 4.

It is to be understood that the form of this invention as shown is merely a preferred embodiment. Various changes may be made in the function an arrangement of parts; equivalent means may be substituted for those illustrated and described; and certain features may be used independently from others without departing from the spirit and scope of the invention as defined in the following claims.

What is claimed is:

1. In a particulate material blender of the type which includes a vertically oriented vessel with a top and bottom, the vessel being constructed with an upper section which includes the top of the vessel, a source of pressurized gas attached to the vessel at a gas entry near the bottom of the vessel, and a lift pipe supported within the vessel and extending from a location near the top of the vessel to a location above the gas entry, the improvement comprising:

a. an exit pipe attached to and extending above the lift pipe and out of the vessel;

b. a first opening in the lift pipe located near the top of the vessel and above the top surface of the material within the vessel through which a portion of the gas and material moving within the lift pipe exits the lift pipe;

c. an adjustable deflector located within the lift pipe and adjacent to the first opening in the lift pipe and shaped to divert a portion of the gas and material moving in the lift pipe into the exit pipe and allow a portion of the material moving in the lift pipe to exit out of the lift pipe through the adjacent first opening into the vessel above the top surface of the material within the vessel;

d. a second opening in the lift pipe located to permit gas to re-enter the lift pipe from the region of the vessel which is above the top surface of the material within the vessel;

e. positioner means for adjusting the position of the deflector within the lift pipe to thereby vary the amount of gas and material that will exit the lift pipe through the opening specified in (b); and f. a hood structure located near the top of the blander and enclosing within it the adjustable deflector and the upper portion of the lift pipe including the first opening and the second opening, the hood structure being open at its bottom and extending downward within the blender so that, under normal operating conditions, the bottom opening of the hood structure is covered by the material within the blender.

2. The blender of claim 1 further comprising a seal leg for the vessel located near the bottom of the vessel.

3. The blender of claim 1 further including sensor means associated with the exit pipe and interconnected with the positioner means, the sensor means measuring the quantity of material flowing in the exit pipe and controlling the positioner means based upon the quantity of material flowing in the exit pipe.

4. The blender of claim 3 wherein the sensor means comprise a pneumatic differential pressure measuring device.

* * * * *